US005583527A

United States Patent [19]

Fujisaki et al.

[11] Patent Number: 5,583,527

[45] Date of Patent: Dec. 10, 1996

[54] FLAT DISPLAY

[75] Inventors: Takashi Fujisaki; Akira Otsuka; Toshio Ueda; Sigetoshi Tomio; Masaya Tajima, all of Kawasaki, Japan

[73] Assignee: Fujitsu Limited, Kawasaki, Japan

[21] Appl. No.: 188,902

[22] Filed: Jan. 31, 1994

[30] Foreign Application Priority Data

Nov. 26, 1993 [JP] Japan ..... 5-296910

[51] Int. Cl.[6] ..... G09G 3/20

[52] U.S. Cl. ..... 345/55; 345/37; 345/60; 345/211

[58] Field of Search ..... 345/211, 212, 345/45, 36, 37, 60–63, 66–69, 72, 77, 55; 315/169.3, 169.4

[56] References Cited

U.S. PATENT DOCUMENTS

| | | | |
|---|---|---|---|
| 3,626,244 | 12/1971 | Holz | 315/169 R |
| 4,225,807 | 9/1980 | Ise et al. | 315/169.3 |
| 4,349,819 | 9/1982 | Terakawa | 345/211 |
| 5,311,104 | 5/1994 | Antle | 315/169.4 |

FOREIGN PATENT DOCUMENTS

| | | | |
|---|---|---|---|
| 0554066 | 8/1993 | European Pat. Off. . | |
| 2397696 | 2/1979 | France . | |
| 1193797 | 8/1989 | Japan | 345/60 |
| 3-182792 | 8/1991 | Japan . | |
| 3-269482 | 12/1991 | Japan | 345/63 |
| 4-128874 | 4/1992 | Japan . | |
| 4338998 | 11/1992 | Japan | 345/60 |

OTHER PUBLICATIONS

Translation of Kuriyama (Japan Kokai No. 4–338998).

*Primary Examiner*—Ulysses Weldon
*Attorney, Agent, or Firm*—Staas & Halsey

[57] ABSTRACT

In a flat display, an address current detecting unit detects a value of address current consumed during each display frame, a comparator compares the address current value detected by the address current detecting unit with a given reference value, and an address-frequency control unit controls address frequencies related to the display frame in response to the output of the comparator.

6 Claims, 12 Drawing Sheets

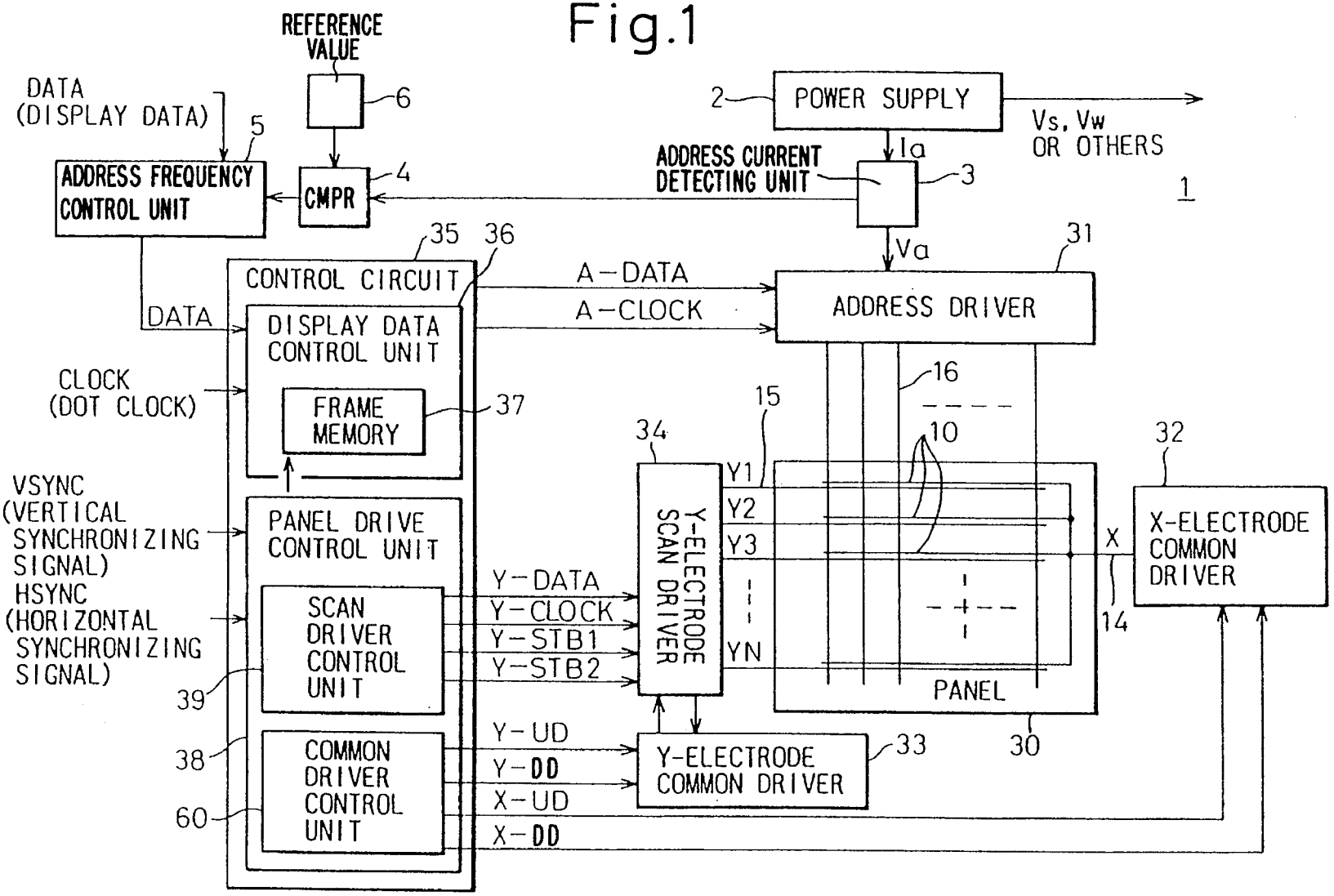
Fig.1
POWER SUPPLY
2
Ia
3
Va
Vs, Vw OR OTHERS
1
ADDRESS CURRENT DETECTING UNIT
ADDRESS DRIVER
31
16
10
X-ELECTRODE COMMON DRIVER
32
X
14
PANEL
30
33
Y-ELECTRODE COMMON DRIVER
15
Y1
Y2
Y3
YN
Y-ELECTRODE SCAN DRIVER
34
A-DATA
A-CLOCK
Y-DATA
Y-CLOCK
Y-STB1
Y-STB2
Y-UD
Y-DD
X-UD
X-DD
REFERENCE VALUE
6
4
CMPR
5
ADDRESS FREQUENCY CONTROL UNIT
DATA (DISPLAY DATA)
DATA
CONTROL CIRCUIT
35
36
DISPLAY DATA CONTROL UNIT
37
FRAME MEMORY
PANEL DRIVE CONTROL UNIT
SCAN DRIVER CONTROL UNIT
COMMON DRIVER CONTROL UNIT
39
38
60
CLOCK (DOT CLOCK)
VSYNC (VERTICAL SYNCHRONIZING SIGNAL)
HSYNC (HORIZONTAL SYNCHRONIZING SIGNAL)

Fig.3

| SFEN 0 | SFEN 1 | SFEN 2 | $R_0,G,B$ | $R_1,G,B$ | $R_2,G,B$ | $R_3,G,B$ | $R_4,G,B$ | $R_5,G,B$ | $R_6,G,B$ | $R_7,G,B$ |
|---|---|---|---|---|---|---|---|---|---|---|
| L | L | L | H | H | H | H | H | H | H | H |
| H | L | L | L | H | H | H | H | H | H | H |
| L | H | L | L | L | H | H | H | H | H | H |
| H | H | L | L | L | L | H | H | H | H | H |
| L | L | H | L | L | L | L | H | H | H | H |
| H | L | H | L | L | L | L | L | H | H | H |
| L | H | H | L | L | L | L | L | L | H | H |
| H | H | H | L | L | L | L | L | L | L | H |

Fig. 5

| SFEN 0 | SFEN 1 | SFEN 2 | $R_0$,G,B | $R_1$,G,B | $R_2$,G,B | $R_3$,G,B | $R_4$,G,B | $R_5$,G,B | $R_6$,G,B | $R_7$,G,B |
|---|---|---|---|---|---|---|---|---|---|---|
| L | L | L | L | L | L | L | L | L | L | L |
| H | L | L | H | L | L | L | L | L | L | L |
| L | H | L | H | H | L | L | L | L | L | L |
| H | H | L | H | H | H | L | L | L | L | L |
| L | L | H | H | H | H | H | L | L | L | L |
| H | L | H | H | H | H | H | H | L | L | L |
| L | H | H | H | H | H | H | H | H | L | L |
| H | H | H | H | H | H | H | H | H | H | L |

Fig.10 (PRIOR ART)

ONE DRIVE CYCLE → TIME

| DISPLAY LINE | | | | | | | | | | | | | | |
|---|---|---|---|---|---|---|---|---|---|---|---|---|---|---|
| 1 | W | S | S | S | S | S | S | S | S | S | S | S | S | S |
| 2 | s | W | S | S | S | S | S | S | S | S | S | S | S | S |
| 3 | s | s | W | S | S | S | S | S | S | S | S | S | S | S |
| 4 | s | s | s | W | S | S | S | S | S | S | S | S | S | S |
| 5 | s | s | s | s | W | S | S | S | S | S | S | S | S | S |
| 6 | s | s | s | s | s | W | S | S | S | S | S | S | S | S |
| 7 | s | s | s | s | s | s | W | S | S | S | S | S | S | S |
| 8 | s | s | s | s | s | s | s | W | S | S | S | S | S | S |
| 9 | s | s | s | s | s | s | s | s | W | S | S | S | S | S |
| 10 | s | s | s | s | s | s | s | s | s | W | S | S | S | S |
| 11 | s | s | s | s | s | s | s | s | s | s | W | S | S | S |
| 12 | s | s | s | s | s | s | s | s | s | s | s | W | S | S |
| 13 | s | s | s | s | s | s | s | s | s | s | s | s | W | S |
| 14 | s | s | s | s | s | s | s | s | s | s | s | s | s | W |

W:DRIVE CYCLE FOR REWRITING
S:DRIVE CYCLE FOR SUSTAINING DISCHARGE ALONE
s:DRIVE CYCLE FOR SUSTAINING DISCHARGE ALONE FOR A PREVIOUS FRAME

FLAT DISPLAY

BACKGROUND OF THE INVENTION

1. Field of the Invention

The present invention relates to a flat display such as a plasma display or an electroluminescent (EL) display. More particularly, this invention is concerned with an address current suppressing unit for use in a brightness drive performed in a flat display.

2. Description of the Related Art

Flat displays including a plasma display and an electroluminescent (EL) display have small depths. Moreover, the flat displays permit the construction of large display screens. The application range and production scale of the flat displays are therefore rapidly expanding.

In general, a flat display utilizes a charge accumulated between electrodes and causes a discharge to emit light for display. For better understanding of the general principle of display, the structure and operation of, for example, a plasma display will be described briefly.

Well-known conventional plasma display (AC type PDP) fall into one of dual-electrode type-that uses two electrodes for selective discharge (addressing discharge) and sustaining discharge and a triple-electrode type that uses three electrodes for addressing discharge.

In a plasma display (PDP) for a color display, infrared rays resulting from discharge are used to excite phosphors disposed in the discharge cells. The phosphors are susceptible to the impact of ions or positive charges, induced by the discharge. The above dual-electrode type has a structure such that the phosphors are directly hit by the ions. This structure may reduce the service lives of phosphors.

To avoid the deterioration, the color plasma display usually employs the triple-electrode structure based on surface discharge.

The triple-electrode type falls into an arrangement in which the third electrode is formed on the substrate on which first and second electrodes thereof, used for sustaining discharge, are arranged and an arrangement in which a third electrode is formed on another substrate opposed to the one on which the first and second electrodes are arranged.

In the arrangement in which three electrodes are formed on the same substrate, the third electrode may be placed on, or under, the two electrodes for sustaining discharge.

Furthermore, visible light emitted from phosphors may be transmitted or reflected by the phosphors for observation.

The foregoing plasma displays of different types have the same operating principle. Mention will therefore be made of a flat display in which first and second electrodes for sustaining discharges are formed on a first substrate and a third electrode is formed on a second substrate opposed to the first substrate, by presenting embodiments thereof.

FIG. 6 is a schematic plan view showing a configuration of the aforesaid triple-electrode type plasma display (PDP). FIG. 7 is a schematic sectional view of one of discharge cells 10 formed in the plasma display shown in FIG. 6.

As apparent from FIGS. 6 and 7, the plasma display comprises two glass substrates 12 and 13. The first substrate 13 has first electrodes (X electrodes) 14 and second electrodes (Y electrodes) 15. The first electrodes 14 and second electrodes 15 serve as sustaining electrodes, lie in parallel with one another, and are shielded with a dielectric layer 18.

A coat (i.e., a coating, or layer) 21 made of magnesium oxide (MgO) is formed as a protective coat over the discharge surface that is the dielectric layer 18.

On the surface of the second substrate 12, opposed to the first glass substrate 13, electrodes 16 acting as third electrodes or address electrodes are formed to intersect the sustaining electrodes 14 and 15.

On the address electrodes 16, phosphors 19 each having one of red, green, and blue light-emitting characteristics are placed in discharge spaces 20, each defined by walls 17 formed on the surface of the second substrate 12 on which the address electrodes are arranged.

Discharge cells 10 in the plasma display are separated from one another by partitions.

In the plasma display 1 of the aforesaid example, the first electrodes (X electrodes) 14 and second electrodes (Y electrodes) 15 are lying in parallel with one another and paired. The second electrodes (Y electrodes) 15 are driven independently, while the first electrodes (X electrodes) 14 act as a common electrode and are driven by a single driver.

FIG. 8 is a schematic block diagram showing peripheral circuits for driving the plasma display shown in FIGS. 6 and 7. The address electrodes 16 are connected one by one to an address driver 31. During addressing discharge, the address driver 31 applies an address pulse to each address electrode.

The Y electrodes 15 are connected one by one to a Y-electrode scan driver 34.

The scan driver 34 is connected to a Y-electrode common driver 33. For addressing discharge, pulses are generated by the scan driver 34. For sustaining discharge, pulses are generated by the Y-electrode common driver 33, and then applied to the Y electrodes 15 via the Y-electrode scan driver 34.

The X electrodes 14 are connected in common with respect to all display lines on a panel of the flat display.

An X-electrode common driver 32 generates a write pulse and a sustaining pulse, and applies these pulses to the X electrodes 14 concurrently. These drivers are controlled by a control circuit 35. The control circuit is controlled with a synchronizing signal and a display data signal which are supplied by an external unit.

As apparent from FIG. 8, the address driver 31 is connected to a display data control unit 36 incorporated in the control circuit 35. The display data control unit 36 inputs a dot clock signal CLOCK and a display data signal DATA, which are display data and are supplied from an external unit, and outputs data via, for example, a frame memory 37 incorporated in the display data control unit 36 according to the timing of addressing address electrodes which are to be selected for one frame.

The Y-electrode scan driver 34 is connected to a scan driver control unit 39 in a panel drive control unit 38 incorporated in the control circuit 35. In response to a vertical synchronizing signal $V_{SYNC}$, that is a signal instructing the start of scanning one frame (or field) and supplied by an external unit, and a horizontal signal $H_{SYNC}$, that is a signal instructing the start of one horizontal scanning period, the Y-electrode scan driver 34 is driven to select a plurality of Y electrodes 15 in the flat display 30 one by one. Thus, an image of one frame is displayed.

In FIG. 8, Y-DATA denotes scan data that is supplied by the scan driver control unit 39 and used to turn on the Y-electrode scan driver 34 bit by bit. Y-CLOCK denotes a transfer clock pulse for use in turning on the Y-electrode scan driver 34 bit by bit.

Y-STB1 denotes a timing signal for use in turning on the Y-electrode scan driver. Y-STB2 denotes a timing signal for use in turning off the Y-electrode scan driver 34.

The X-electrode common driver 32 and Y-electrode common driver 33 in this example are connected to a common driver control unit 40 incorporated in the control circuit 35. The X electrodes 14 and Y electrodes 15 are driven all together (i.e., in common) by reversing polarities of applied voltages alternately. Thus, the aforesaid sustaining discharge is executed.

In FIG. 8, an X-UD signal, supplied by the common driver control unit 40, is used to control the on and off states of the X common driver 32, and the X-UD signal includes voltage signals Vs and Vw. An X-DD signal, supplied by the common driver control unit 40, is used to control the on and off states of the X-electrode common driver and the X-DD signal includes a GND level signal.

Likewise, a Y-UD signal supplied by the common driver control unit 40 is used to control the on and off states of the Y-electrode common driver, and the Y-UD signal includes voltage signals Vs and Vw. A Y-DD signal supplied by the common driver control unit 40 is used to control the on and off states of the Y-electrode common driver and the Y-DD signal includes a GND level signal.

FIG. 9 shows waveforms in a first example of a conventional method of driving the plasma display PDP shown in FIGS. 6 and 7. FIG. 9 shows one drive cycle in a line-sequential drive and self-erasure addressing mode.

In this example, at a time instant (1) during one drive cycle, the voltages of the X electrodes are held at 0V, and a voltage −Vs is applied simultaneously to the Y electrodes associated with all sub-frames constituting one frame. Thus, the voltage waveforms of all the display lines corresponding to the sub-frames are re-shaped in terms of phase.

Since it is unknown which phase was set last for display lines corresponding to sub-frames in a previous frame, the respective phases of all display lines should preferably be synchronized to each other to form a new frame. That is why the operation at the time instant (1) is necessary.

Next, at a time instant (2) in FIG. 9, voltage −Vs is applied to the Y electrodes associated with a display line (C) which is selected by the Y-electrode scan driver and common driver to write display data, while 0V is applied to the Y electrodes associated with the other display lines (D) except the selected display line. (A voltage Vs is a sustaining voltage.)

In this embodiment, a write voltage Vw is applied as a write pulse to the X electrodes at the same time. At this instant, a voltage exceeding a discharge start voltage Vf is applied to the discharge spaces 20. This causes a discharge to start. The selected display line has a voltage Vs+Vw, while the unselected display lines have the voltage Vw.

When Vs+Vw>Vf (discharge start voltage)>Vw is established, a selected display line alone can be discharged.

At the time instant (2), all the cells 10 associated with the selected line are written.

A positive surface charge accumulated between the walls (referred to as "wall charge") is therefore accumulated in the protective coat (MgO coat) over the X electrodes 14 associated with the selected line (C), while a negative wall charge is accumulated in the protective coat (MgO coat) over the Y electrodes associated with the selected line.

As discharge progresses, the wall charges have a polarity causing the electric fields in the discharge spaces 20 to shrink. The discharge therefore dies down and lasts only for one to several microseconds.

Next, at a time instant (4). in FIG. 9, the sustaining pulse of the voltage −Vs is applied alternately to the X electrodes 14 and the Y electrodes 15 associated with the selected display line. The wall charge accumulated is added to the applied voltages. Thus, sustaining discharge is repeated in all the cells except those not to be lit (illuminated).

In this embodiment, at a time instant (3) in FIG. 9, a sustaining pulse is applied to the X electrodes in the cells 10 not to be lit. After a negative wall charge is accumulated in the MgO coat over the Y electrodes associated with the selected line, synchronously with the sustaining pulse applied first to the Y electrodes associated with the selected line, an address pulse ADP of a positive voltage Va is applied selectively to the address electrodes in the cells 10 not to be lit.

Sustaining discharge occurs in all the cells associated with the selected display line. In the cells whose address electrodes are supplied with the address pulse ADP, especially, the sustaining discharge triggers discharges between the address electrodes and Y electrodes. Consequently, positive wall charge is accumulated excessively in the MgO coat over the Y electrodes.

When the voltage Va is set to such a value that allows the produced wall charge itself to exceed the discharge start voltage, after an external voltage is removed, that is, after the X and Y electrodes are set to 0V and the address electrodes are set to ground, the voltage of the wall charge itself starts discharging.

As for this discharge, since the potential difference between the X and Y electrodes is 0V, the space charge or wall charge resulting from the discharge will not accumulate in the MgO coat over the X and Y electrodes. The space charge is recombined and neutralized in the discharge spaces. This action is referred to as self-erasure discharge.

Thereafter, even if the sustaining pulse −Vs is applied alternately to the X and Y electrodes, sustaining discharge will not occur but erasure is effected. As for the cells to be lit, the address pulse ADP is not applied to the address electrodes of the cells. Sustaining discharge alone occurs but self-erasure discharge does not. With a sustaining pulse applied thereafter, sustaining discharge is repeated.

As mentioned above, display data is written for a selected display line during one drive cycle. In this embodiment, the writing is executed for each display line.

FIG. 10 is a timing chart for the writing. In FIG. 10, W denotes a drive cycle for writing. S denotes a drive cycle for sustaining discharge alone and s denotes a drive cycle for sustaining discharge for a previous frame (or field).

FIG. 11 shows waveforms in the second example of A conventional method of driving the plasma display panel shown in FIGS. 6 and 7. FIG. 11 shows one sub-frame (or sub-field) period SF in a write addressing mode of an addressing/sustaining discharge separated style.

In this example, one sub-frame period SF consists of at least a reset period 61, an addressing period 62) and a sustaining discharge period 63. The reset period 61 is provided to erase data, concerning the sub-frames of a previous frame, immediately before displaying a new image of one frame. During the reset period 61, all the Y electrodes are de-energized, to be at 0V, and a write pulse of a voltage Vw is applied to the X electrodes at the same time.

Thereafter, the Y electrodes are supplied with a voltage Vs and the X electrodes are de-energized, to be at 0V. Sustaining discharge then occurs in all the cells. This leads to execution of whole-screen write, whereby an erasure pulse EP is applied to the X electrodes 14 so that information recorded in all the cells 10 are erased temporarily. This is the reset period 61.

In this example, during the reset period 61, first, all the Y electrodes are de-energized to 0V. At the same time, all the cells associated with all display lines are discharged; that is, the write pulse of the voltage Vw is applied to the X electrodes. The Y electrodes are then supplied with the voltage Vs, and the X electrodes are de-energized to have 0V at the same time. Thus, a sustaining discharge is effected in all the cells. Erasure discharge occurs between the X electrodes and Y electrodes, whereby each wall charge disappears (part of the wall charge is neutralized).

The reset period 61 is useful for placing all the cells in the same state irrespective of whether or not they are lit for a previous sub-frame, and is intended to hold the wall charge, which triggers an address discharge, at a voltage that does not start a discharge as a result of the next sustaining pulse.

In this example, the reset period 61 is succeeded by the addressing period 62. During the addressing period 62, addressing discharge is effected line-sequentially so that the cells are turned on or off depending on the display data to be placed in the cells. First, a scan pulse SCP of 0V is applied to the Y electrodes. The address pulse ADP of the voltage Va is applied to the address electrodes in the cells to be subjected to sustaining discharge or to be lit. Thus, the cells to be lit are discharged for writing. This brings about minor discharge, which will not be discerned directly, between the address electrodes and selected Y electrodes. A given amount of charge is then accumulated in the cells 10. Thus, (address) writing for one display line terminates.

The foregoing operation is performed for the other display lines sequentially. New display data are thus written for all the display lines.

Thereafter, during the sustaining discharge period 63, the sustaining pulse of the voltage Vs is applied alternately to the Y electrodes and X electrodes. Thus, sustaining discharge is effected. An image is displayed in units of controlled sub-frames together constituting a complete frame for each primary color.

In the aforesaid write addressing mode of an addressing/sustaining discharge separated style, a brightness level of a display screen is determined depending on the length of the sustaining discharge period or the number of sustaining pulses.

A brightness level of a pixel in the display screen depends on the number of sustaining discharge cycles performed during the sustaining discharge period 63 for each sub-frame, under the setting conditions for each sub-frame. In short, a brightness level is dependent on the length of the sustaining discharge period.

In principle, the greater the number of sustaining discharge cycles performed during the sustaining discharge period 63, the higher the brightness becomes. Otherwise, the brightness becomes lower.

For determining a brightness level, an optimal one of multiple predetermined sub-frame patterns, of which the numbers of sustaining discharge cycles are different from one another due to different given weights, is selected for each sub-frame, and then a sustaining discharge is executed for the sub-frame. After this operation is executed for all sub-frames of one frame, a brightness level for the frame is determined.

In this example, as shown in FIG. 12, one frame is divided into eight sub-frames SF1 to SF8. The length of the sustaining discharge period 63 is different from sub-frame to sub-frame.

The reset period 61 and addressing period 62 are the same in length among the sub-frames SF1 to SF8. However, the length of the sustaining discharge period 63 differs from sub-frame to sub-frame. For example, the numbers of sustaining discharge cycles for the sub-frames SF1 to SF8 are set to have a relationship of 1:2:4:8:16:32:64:128. By selecting any one or ones of the patterns shown as the sub-frames SF1 to SF8 in FIG. 12 using addresses, the numbers of sustaining discharge cycles for sub-frames in one frame can be changed appropriately.

In this example, brightness can be set to any one of 256 levels.

This example, based on the addressing mode of an addressing/sustaining discharge separated style, is utilized for the display with a large number of scanning lines (corresponding to display lines) or the full-color display with multiple brightness levels. The configuration and operation for this addressing mode are disclosed in, for example, Japanese Unexamined Patent Publication No. 4-195188.

An example of actual time allocation in the aforesaid example will be described below. Assuming that screen rewriting is performed at 60 Hz, it takes 16.6 ms (1/60 Hz) to rewrite one frame. Assuming that the number of sustaining discharge cycles for one frame is 510, the number of sustaining discharge cycles for the sub-frame SF1 is 2, that for the sub-frame SF2 is 4, that for the sub-frame SF3 is 8, that for the sub-frame SF4 is 16, that for the sub-frame SF5 is 32, that for the sub-frame SF6 is 64, that for the sub-frame SF7 is 128, and that for the sub-frame SF8 is 256. Assuming that it takes 8 microseconds to complete a sustaining discharge cycle, 4.08 ms is required to complete all the sustaining discharge cycles for one frame. The remaining 12 milliseconds or so is allocated to eight addressing periods. It takes about 1.5 milliseconds to complete the addressing period for each sub-frame. Assuming that about 50 microseconds is required for the reset period preceding each addressing period, it takes 3 microseconds to complete each addressing cycle for driving a panel having 500 scanning lines.

The addressing mode of an addressing/sustaining discharge separated style is currently the most effective mode for displaying images at different brightness levels, wherein a memory in an AC plasma display PDP or an electroluminescent (EL) display is utilized for effective use of time.

Address current flowing through an AC plasma display PDP or electroluminescent (EL) display having the aforesaid configuration is broadly divided into address electrode-to-address electrode capacitance discharge current (hereinafter, A-A current), address write current, and address driver loss current.

It is the A-A current that is most dominant in a maximum address current. The A-A current is used to charge or discharge a space having a floating capacitance between address electrodes in a panel.

Referring to FIG. 6, two address electrodes A1 and A2 are adjacent to each other and can therefore be modeled as a capacitance.

A square wave having a voltage expressed below is regarded as a signal to be fed to the address electrode A1:

$$V(t)=VmF\ (wt)$$

where, F(wt) denotes a frequency factor of 0 or 1. Assume that the address electrode A2 has a voltage 0 and the capacitance between the address electrodes A1 and A2 is C12, the equation below is established.

$$I(t)=C12Vm\ F'(wt)$$

The A-A current is therefore determined by the A-A capacitance, A-A potential difference, and address frequency. The C12 and Vm values are usually unchanged. The peak address current therefore depends directly on the address frequency.

When cells are arranged in a zigzag pattern, the A-A current becomes maximum. To ensure this A-A current, a large power supply is required. The is disadvantageous in terms of cost and installation.

However, since the zigzag pattern is seldom used, a large power supply is not always required.

In a conventional plasma display PDP which cannot control address current actively, a large power circuit is a must.

SUMMARY OF THE INVENTION

An object of the present invention is to solve the problems underlying in the prior art, and to provide a flat display in which address current is controlled automatically thereby to reduce power consumption, and a power circuit is made small-sized thereby to improve efficiency and economy.

To achieve the aforesaid object, the present invention adopts a technical configuration to be described below. Specifically, at least two substrates having electrodes on the surfaces thereof are arranged closely so that the electrodes effectively intersect (i.e., define intersects) and face each other in mutually opposed relationship. A plurality of intersections, formed between the electrodes, define or construct corresponding cells associated with pixels. Each cell has a capability of a memory for storing a given amount of charge according to a voltage applied to an electrode in the cell. A flat display having the above structure comprises an address current detecting unit for detecting a value of address current consumed for each frame to be displayed on the flat display, a comparator for comparing the address current value detected by the address current detecting means with a given reference value, and an address frequency control circuit for controlling an address frequency or a frequency of a pulse generated by each of the plural address electrodes associated with a display frame.

In one of the preferred modes of the present invention, one frame displayed on the flat display is temporally segmented into a plurality of sub-frames corresponding to scanning lines. Each of the sub-frames is composed of an addressing period during which at least a plurality of cells are selected and written with display data and a sustaining discharge period during which the cells that are written with the display data are discharged so as to emit light for a given period of time. The length of the sustaining discharge period in each sub-frame is varied, depending on a sub-frame address signal that is a weighting signal, whereby a brightness level of one frame to be displayed on the flat display is changed.

A flat display according to the present invention adopts the aforesaid technological configuration. Even when a conventional flat display such as a plasma display PDP or an electroluminescent (EL) display is employed, address current flowing through a plurality of address electrodes can be controlled actively by controlling the frequencies of data pulses applied to the address electrodes. Even a small-sized power circuit can drive the flat display successfully.

BRIEF DESCRIPTION OF THE DRAWINGS

FIG. 1 is a block diagram showing an example of a configuration of a flat display according to the present invention.

FIG. 3 is a truth table of control data handled by the address frequency control unit shown in FIG. 2.

FIG. 5 is a truth table of control data handled by another address frequency control means according to the present invention.

FIG. 10 is a timing chart for writing and sustaining discharge in the conventional flat display.

DESCRIPTION OF THE PREFERRED EMBODIMENTS

Figure 2:
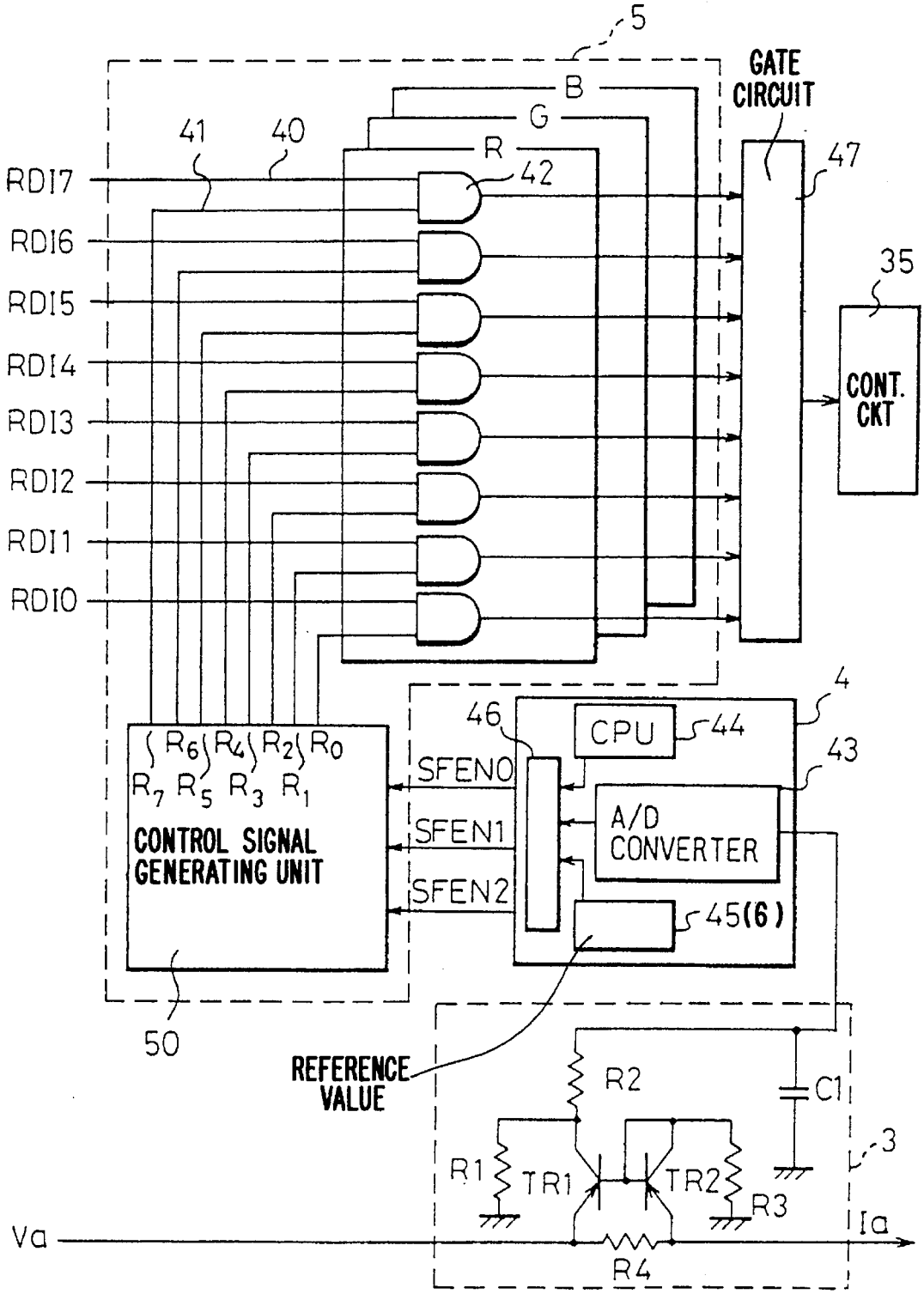
FIG. 2 is a block diagram showing a configuration of an example of an address frequency control unit employed for the flat display according to the present invention.

Referring to the drawings, embodiments of a flat display according to the present invention will be described in detail below.

FIG. 1 is an explanatory diagram showing the principle of a flat display according to the present invention.

Figure 6:
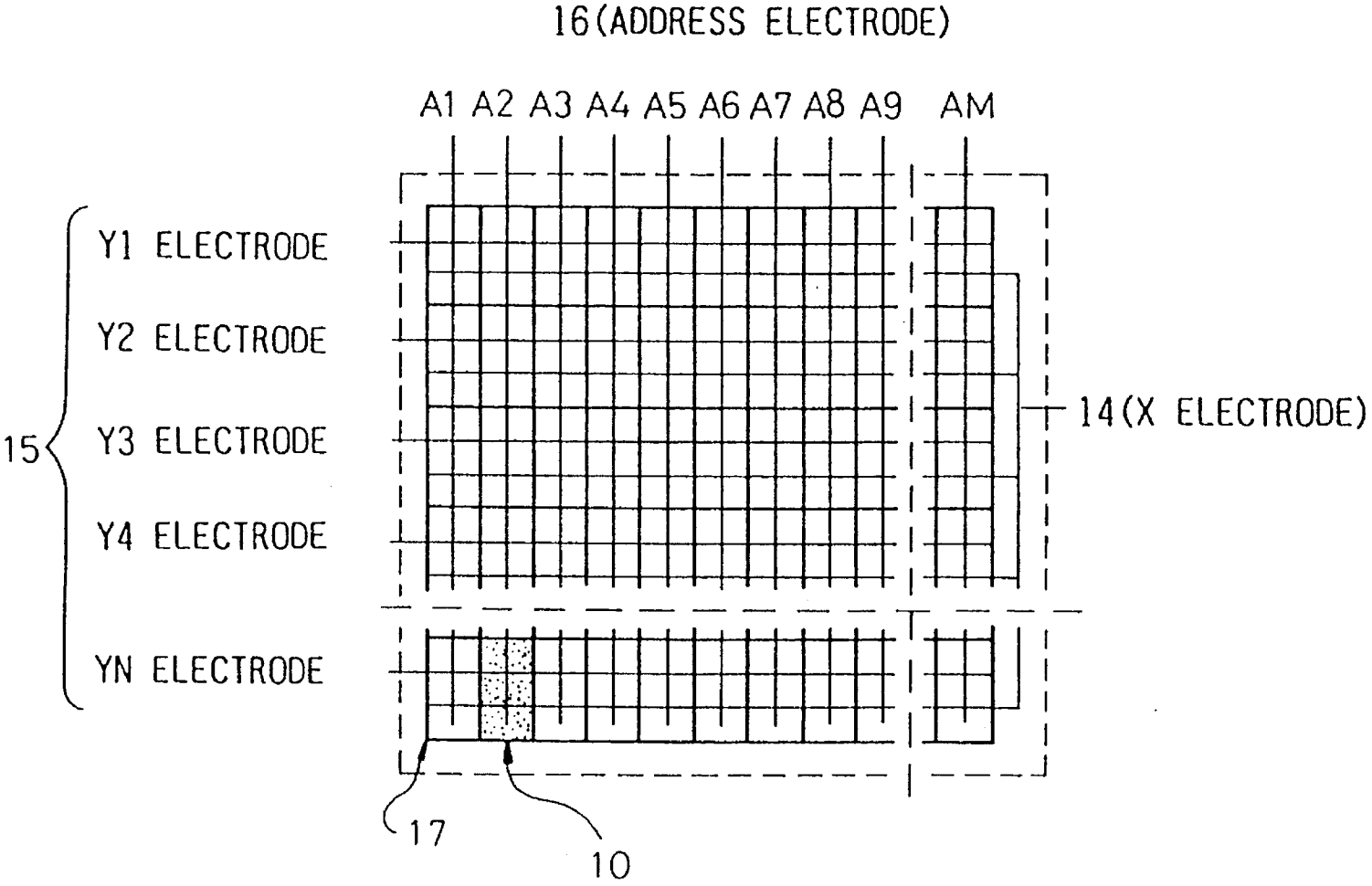
Fig.6 (PRIOR ART)
FIG. 6 is a block diagram showing an example of a conventional flat display.
Figure 7:
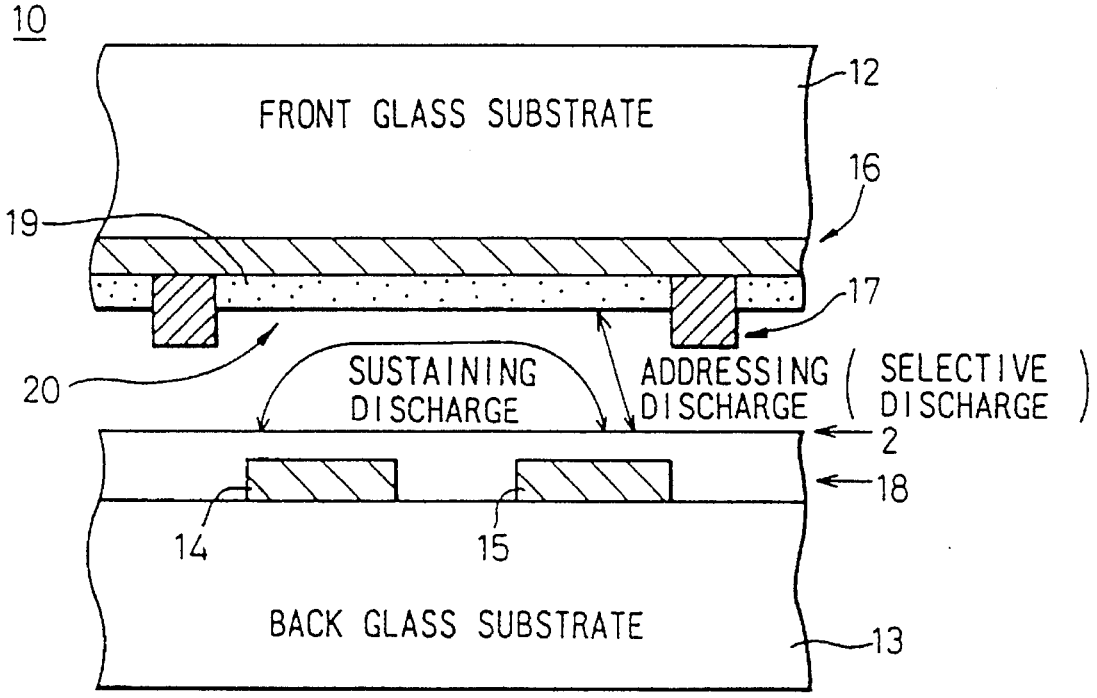
Fig.7 (PRIOR ART)
FIG. 7 is a block diagram showing an example of a structure of a cell in the conventional flat display.
Figure 8:
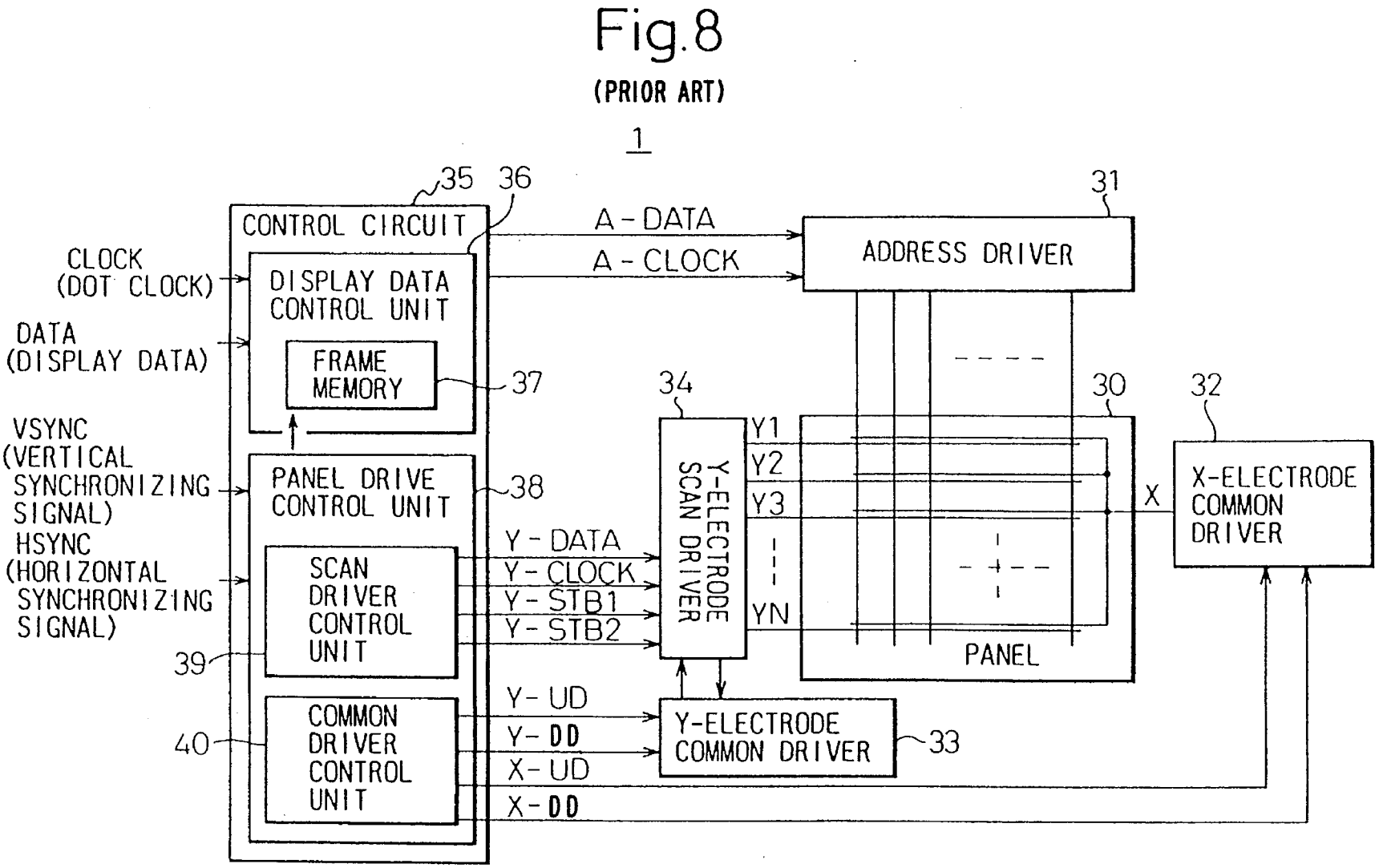
Fig.8 (PRIOR ART)
FIG. 8 is a block diagram showing a circuitry for driving the conventional flat display.
Figure 9:
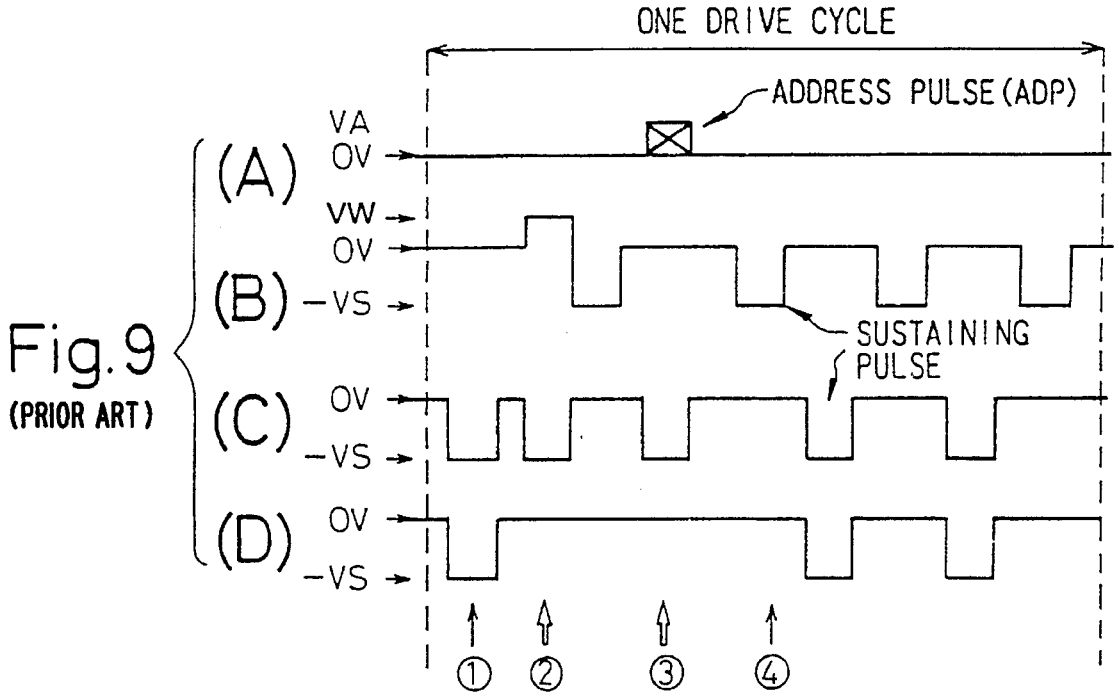
Fig. 9 (PRIOR ART)
FIG. 9 shows waveforms to explain a drive cycle in the conventional flat display.
Figure 11:
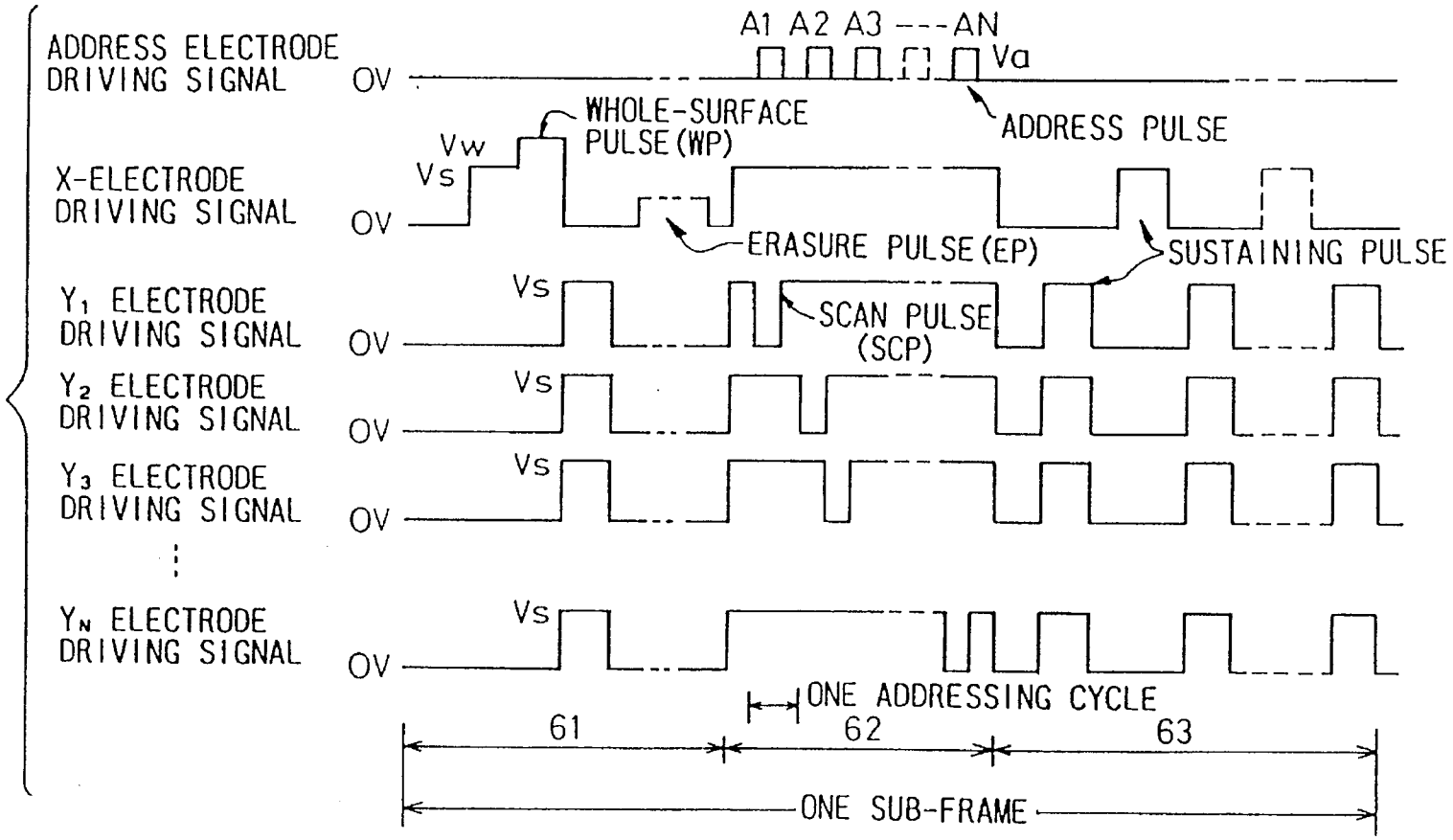
Fig.11 (PRIOR ART)
FIG. 11 shows waveforms to explain another drive cycle in the conventional flat display.

In FIG. 1, the panel 30 is of the type shown in FIGS. 6 and 7 and may comprise two substrates 12 and 13 having electrodes on the surfaces thereof are arranged closely so that the electrodes effectively intersect and face each other in mutually opposed relationship. Phosphors 19 are interposed between the substrates 12 and 13. A plurality of intersections formed between the electrodes construct (i.e., define) cells 10. Each of the cells 10 has a capability of a memory for storing a given amount of charge according to a voltage applied to an electrode in the cell and also has an ability of being discharged and producing light emission. In a flat display having this structure, one frame to be displayed on the flat display is segmented temporally into a plurality of sub-frames SF corresponding to scanning lines. Each of the sub-frames SF is composed of an addressing period 62, during which at least a plurality of cells 10 is selected and written with display data, and a sustaining discharge period 63 during which the cells 10 that are written with display data are discharged so as to emit light for a given period of time. A brightness level of one frame to be displayed on the flat display is changed by appropriately weighting the length of the sustaining discharge period 63 of each sub-frame SF. The flat display comprises an address current detecting unit 3 for detecting a value of the address current consumed for each frame to be displayed on the flat display, a comparator 4 for comparing the address current value detected by the address current detecting unit 3 with a given reference value 6, and an address frequency control unit 5 for controlling the address frequencies related to a display frame in response to the output of the comparator 4.

The flat display 1 according to the present invention may be a plasma display or an electroluminescent display.

The present invention is essentially applicable to any flat display that holds a charge, thereby exert a capability of a memory.

In the flat display 1 according to the present invention, as shown in FIG. 1, the address current detecting unit 3 for detecting an address current Ia is interposed between a power circuit 2 and an address driver 31. The address current detecting unit 3 is not limited to any specific circuitry but may be a known current detecting unit having a capacity for current detection.

FIG. 2 shows an example of a configuration of an example of the address current detecting unit 3 usable for the present invention.

According to this example, the address current detecting unit 3 is connected to a line linking the power supply 2 and the address driver 31. A resistor R4 is connected in the line. The emitters of bipolar transistors TR1 and TR2 are connected across (i.e., to opposite ends of) the resistor 4. The bases of the transistors TR1 and TR2 are connected in common.

The collector of the transistor TR2 is grounded via a resistor R3 and is connected to the base of transistor TR2.

The collector of the transistor TR1 is grounded via a resistor R1 and is connected to one end of a capacitor C1 via a resistor R2. The junction between the resistor R2 and the capacitor C1 is connected to the comparator 4, to be described later.

An address current value to be detected by the address current detecting unit 3 according to the present invention is a value of the address current consumed for each frame, or more preferably, an average of address current values detected relative to a plurality of consecutive frames.

The fundamental technical idea adopted for the present invention causes the aforesaid problems, because when a higher brightness level is set for display of images, the images become brighter and the screens become easy-to-see but the number of data pulses to be applied to each address electrode increases. In other words, the address current flowing through each address electrode increases as the frequency of a data pulse becomes higher.

In the present invention, which attempts to solve the aforesaid problems, a flat display is such that when a given image is to be displayed the address current flowing through address electrodes is detected, and the value of the address current exceeds a predetermined given value, the frequency of the display data to be applied to the address electrode is lowered, and that thus the address current is held at a certain value or less.

In the present invention, when a detected address current exceeds a certain value, any further sustaining discharge cycle within a sustaining discharge period of each sub-frame, is not executed. In other words, a sustaining discharge is not performed at a predetermined time instant at which the sustaining discharge is supposed to be done. Alternatively, even if sustaining discharge is performed, information is output so that the period of an on/off pulse for pixel display data generated by a given address electrode is seemingly shortened.

The address frequency to be controlled in the present invention is a frequency of a pulse simultaneously applied to the plurality of address electrodes.

According to the present invention, address current flowing through the address electrodes may be detected and controlled individually. In practice, the sum of the address current flowing through the whole of the panel 30 of the flat display 1 is detected for more efficient control. It is therefore preferred that address current values be detected in units of one frame to be displayed on the flat display, or in units of a plurality of frames and then averaged, for use in the aforesaid control.

Figure 12:
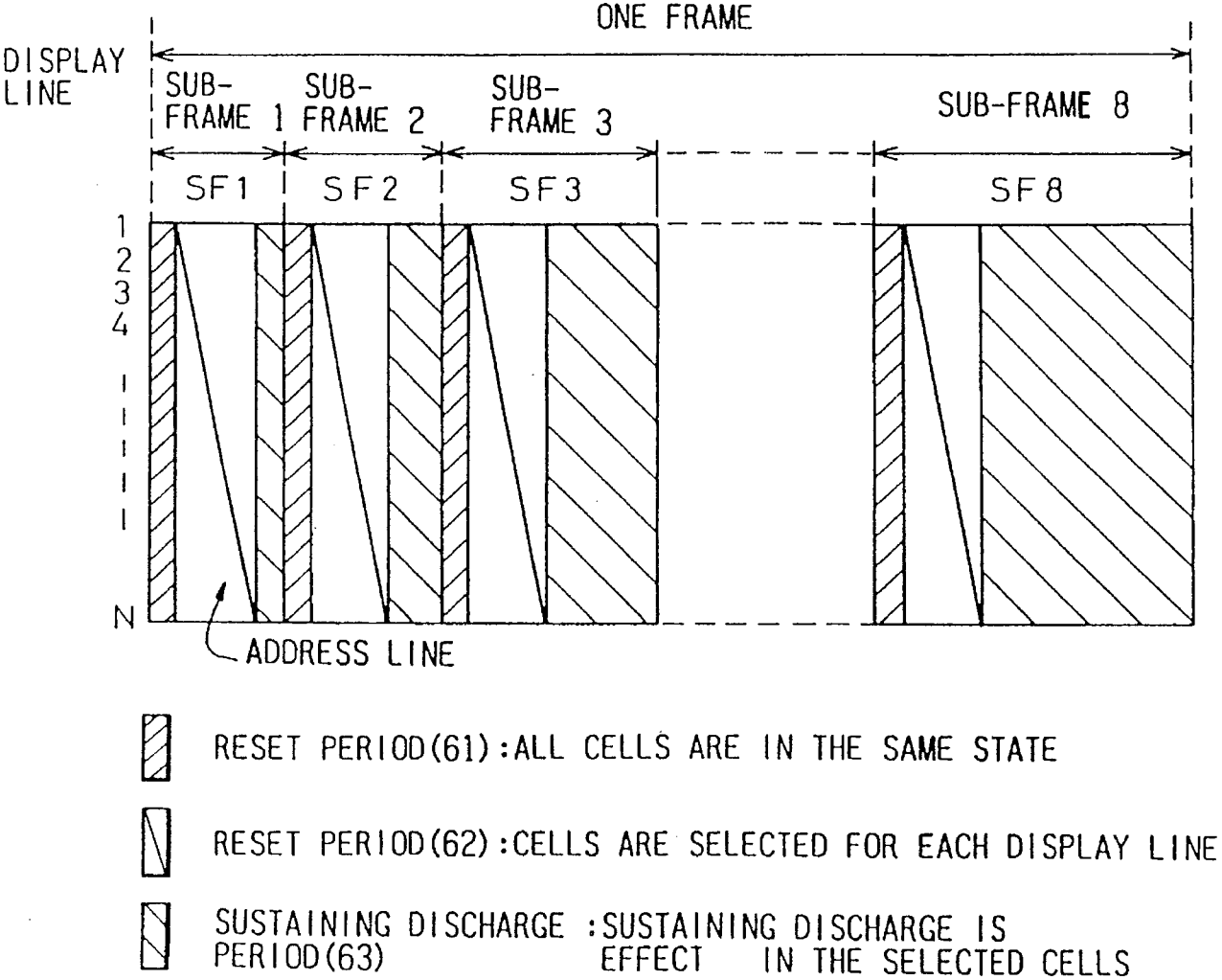
Fig.12 (PRIOR ART)
FIG. 12 shows an example of sub-frame patterns employed in the conventional flat display.

A brightness-level control method for a display screen in the flat display according to the present invention is based on the aforesaid prior art. The particular description will therefore be omitted. In the brightness-level control, the lengths of sustaining discharge periods in display lines of a plurality of sub-frames which constitute one frame and are associated with Y electrodes 15, that is, the numbers of sustaining discharge cycles in the sustaining discharge periods, are set by selecting one pattern or a plurality of patterns from the eight-stepped patterns shown as sub-frames SF1 to SF8 in FIG. 12. The addresses of the sub-frames for which the sustaining discharge frequencies are set, for example, RDI0 to RDI7 (see, FIG. 2), are appended to the display data (DATA) of the frame.

As previously described, one or more, in combination, of the eight-stepped sub-frame patterns SF1 to SF8 is/are used to enable control of display brightness selectively at 256 levels.

In the present invention, the address frequency control unit 5 preferably comprises a plurality of gates 42, which are connected in parallel with one another, each having an input port 40 for inputting a corresponding one of the sub-frame address signals RDI0 to RDI7, that determines which cells in a sub-frame be selected, and an input port 41 for inputting a corresponding one of control signals R0 to R7, provided in response to the output signal of the comparator 4. By controlling the plurality of gates unit 42, the output of a given sub-frame address signal is controlled so as to reduce the relevant address frequencies.

The comparator 4 according to the present invention comprises, for example and as shown in FIG. 2, an A/D converter 43, to which the output of the address current detecting unit 3 is fed, and a reference data output unit 45 that stores a reference current value used relative to an address current value and that is an appropriate storage means. The comparator 4 further comprises a comparing circuit 46 that compares the data provided by the A/D converter 43 with the data provided by the reference data output unit 45, and that when the data sent from the A/D converter 43 represents a higher value than the reference data, outputs a given control signal, and an arithmetic logic unit (CPU) 44 for controlling the actions of these means.

The comparator 4, according to the present invention outputs and as shown in FIG. 2, generates three independent control signals SFEN0, SFEN1, and SFEN2 and supplies same to the address frequency control unit 5 which will be described later. The control signals SFEN0, SFEN1, and SFEN2 have their logical states varied depending on a detected address current value.

FIG. 3 shows an example of logical states of output signals SFEN0, SFEN1, and SFEN2 of the comparator 4.

The address frequency control unit 5 according to the present invention comprises, as shown in FIG. 2, the plurality of gate unit 42, which are connected in parallel with one another, each having the input port 40 for inputting a sub-frame address signal, or any of RDI0 to RDI7, that determines which cells in a sub-frame be selected, and the input port 41 for inputting a control signal, or any of R0 to R7, that are output signals of a control signal generating unit 50 which is incorporated in the address frequency control unit 5 and outputs given control signals. By controlling the plurality of gate unit 42, the output of a given sub-frame address signal is generated so as to change the relevant address frequencies.

The control signal generating unit 50 according to the present invention may have any logical circuitry as long as it can output signals having the voltage levels, shown in FIG. 3, through output terminals R0 to R7 in response to the output signals SFEN0, SFEN1, and SFEN2 of the comparator 4.

Truth values listed in FIG. 3 determine the logical states of signals provided by the control signal generating unit 50. That is to say, the logical states of the output signals SFEN0, SFEN1, and SFEN2 of the comparator 4 are varied depending on the detected value of the address current. The logical states of the output signals sent from the output terminals of the control signal generating unit 50 are determined according to a combination of the logical states of the output signals SFEN0, SFEN1, and SFEN2.

In this example, it is assumed that the address frequency control unit 5 comprises AND gate circuits 42, that the sub-frame address signal RDI7 represents an address indicating a sub-frame for which a large brightness level and thus a high sustaining discharge frequency is specified, and that the sub-frame address signal RDI0 represents an address indicating a sub-frame for which a small brightness level and thus a low sustaining discharge frequency is specified. In this case, when a detected address current value is small, the output signals SFEN0, SFEN1, and SFEN2 of the comparator 4 ire low. The output signals sent from the output terminal of the control signal generating unit 50 are therefore driven high.

When a detected address current value is small, as mentioned above and since all the AND gate circuits 42 are open, any of the sub-frame address signals RDI0 to RDI7 which is input is then output by the control unit 5 to a gate circuit 47, and fed thereby through the control circuit 35 (FIG. 2) to address driver 31 as A-DATA (FIG. 1) control circuit 35 and, more particularly, and with reference to FIG. 1. Sustaining discharge is then executed.

When a detected address current value is slightly larger, the output signal SFEN0 of the comparator 4 is driven high, while the output signals SFEN1 and SFEN2 are held low.

In the foregoing state and as is apparent from the truth table of FIG. 3, the output signal sent from the output terminal R0 of the control signal generating unit 50 goes low. The other output signals provided via the output terminals R1 to R7 stay high.

Even when the sub-frame address signal RDI0 is input, the sub-frame address signal RDI0 is not output by the control unit 5, but are masked. This results in an address frequency reduced by the masked signal portion.

In other words, since the detected address current value is slightly larger, any of the sub-frame address signals RDI7 to RDI0 is masked to compensate for the increase in current. This results in lower address frequencies.

In the present invention, an output signal sent from the output terminal R0 of the control signal generating unit 50 is masked, because the output signal is a sub-frame address signal indicating a sub-frame for which a small brightness level is specified. That is to say, erasing such a sub-frame address signal hardly affects the change in brightness of a whole frame.

Likewise, when a detected address current has a large value, if the output signals SFEN0 and SFEN1 of the comparator 4 go high but the other output signal SFEN2 stays low and as is apparent from the truth table of FIG. 3, the output signals sent from the output terminals R0 to R2 of the control signal generating unit 50 are driven low but the other output signals sent from the output terminals R3 to R7 thereof are held high.

In the foregoing state, even when the sub-frame address signals RDI0 to RDI2 are input as data, the sub-frame address signals RDI0 to RDI2 are not output by the control unit 5, but are masked. This results in address frequencies reduced by those of the masked signals.

Figure 4A:
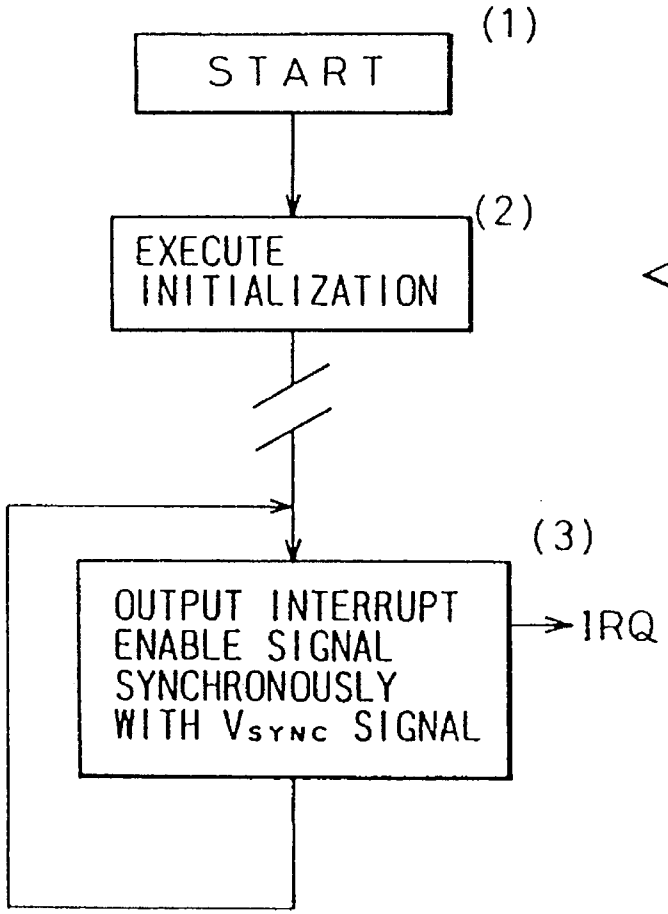
FIGS. 4A and 4B are flowcharts showing a procedure of address frequency control according to the present invention.
Figure 4B:
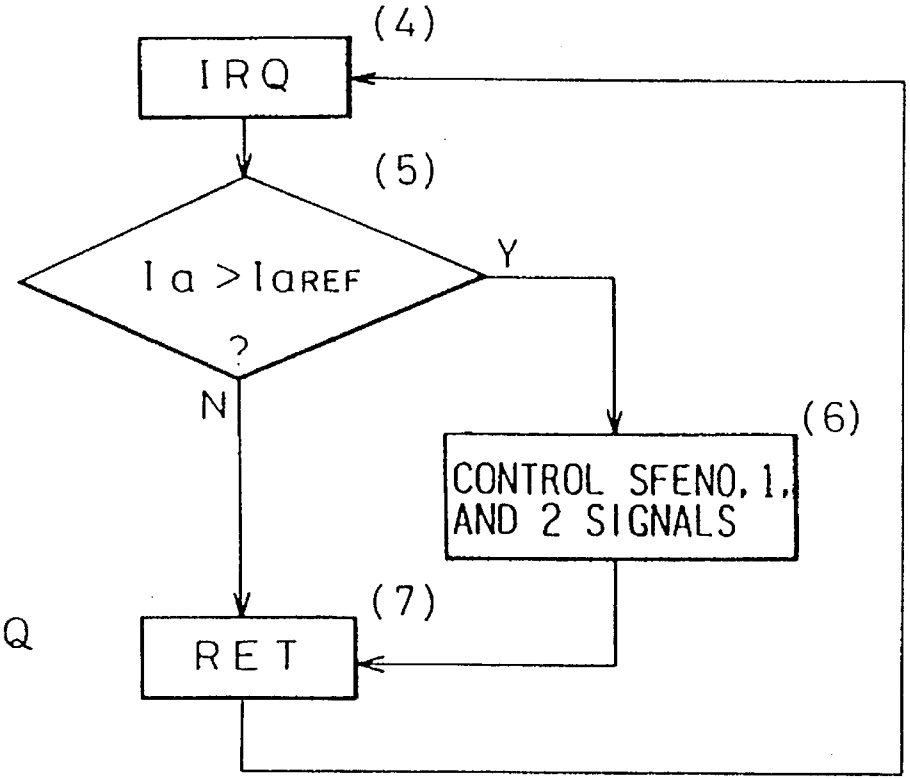

An example of a procedure for executing brightness-level control according to the present invention will be described in conjunction with the flowcharts of FIGS. 4(A) and 4(B).

In a flat display of the present invention, image displaying starts at a step (1). At a step (2), initialization is executed to set initial data that are given conditions. The image displaying then actually starts.

Control is then passed to a step (3). When an image of one frame is displayed, an interrupt enable signal for enabling execution of a subroutine of address current detection is output in synchronization with a $V_{SYNC}$ signal. Control is then passed to a step (4). The subroutine then starts.

At a step (5), a detected address current value Ia is compared with a reference current value $Ia_{REF}$. If the Ia value is larger than the $Ia_{REF}$ value, control is passed to a step (6). The aforesaid control is then executed. Control is then passed to a step (7), and returned to the step (4).

If it is found at the step (5) that the Ia value is not larger than the $Ia_{REF}$ value, control is passed directly to the step (7) and then returned to the step (4).

In this example, when a color display is to be implemented, the aforesaid control unit 5 is provided for each of three colors; red, blue, and green. The aforesaid operations are then executed for each color.

In another example of the address frequency control unit 5, the AND gate circuits 42 shown in FIG. 2 may be replaced by with, for example, OR gate circuits. In this case, a truth table shown in FIG. 5 is adopted to control signals sent from the output terminals of the control signal generating unit 50.

In this example, unlike the aforesaid example, even when any of the sub-frame address signals RDI0 to RDI7 is not input, required ones of the sub-frame address signals RDI0 to RDI7 are output according to the detected address current value Ia. Thus, the address frequencies are controlled.

In this case, a timing chart as shown in FIG. 10 is adopted. All the sub-frame address signals, indicating selected sub-frames, go high.

As described so far, according to the present invention, address frequencies are automatically controlled to cope with an increase in address current. Thus, address power can be limited to a reference value or less.

This permits a small-sized power supply.

The aforesaid control method adopted for the flat display of the present invention is applicable to an addressing mode of either a conventional line-sequential self-erasure type or a conventional batch write/erase type.

We claim:

1. A drive system for a flat display of first and second substrates, each having a main surface and plural electrodes disposed in parallel on the main surface and with the respective main surfaces thereof disposed in parallel, spaced relationship and with the respective electrodes thereof in perpendicular relationship so as to define a matrix of plural crossing points between the respective electrodes of the first and second substrates, at least one crossing point defining a display cell and serving as a pixel of the display, said drive system comprising:

a brightness level controlling circuit for changing the respective brightness levels of frames to be displayed on said flat display, in which a single frame to be so displayed is segmented temporally into a plurality of sub-frames corresponding to scanning lines, said brightness level controlling circuit changing the brightness level by variously selecting some of the sub-frames;

an address current detecting circuit, operatively connected to said pluralities of electrodes, for detecting a value of an address current which is consumed for producing a display on said flat display;

a comparator circuit which compares the value of the consumed address current, detected by said address current detecting circuit, with a reference current value and produces a comparison output; and an address frequency control circuit, operatively connected to said electrodes, which selectively disables the sub-frames in response to the comparison output of the comparator, to thereby control an address frequency, and thus a number of address pulses applied to each of said pluralities of electrodes associated with a display frame, and thereby the brightness level of the display.

2. A drive system according to claim 1, wherein said flat display is a plasma display.

3. A drive system according to claim 1, wherein the address current detecting circuit, further, detects respective, plural address current values in plural, successive frames and produces an average thereof as the address current value.

4. A drive system for a flat display according to claim 1, wherein said address frequency control circuit further comprises a plurality of gates connected in parallel and having respective, first input ports receiving a sub-frame address signal which determines sub-frames to be selected and respective, second input ports receiving corresponding control signals determined in accordance with the comparison output of the comparator, the comparison outputs of the comparator controlling the plurality of gate means so as to output therefrom a sub-frame address signal which is controlled so as to reduce the address frequencies.

5. A drive system for flat display according to claim 1, wherein said address frequency control means further comprises a plurality of gates connected in parallel and having respective, first input ports receiving a sub-frame address signal which determines sub-frames to be selected and respective, second input ports receiving corresponding control signals determined in accordance with the comparison output of the comparator, the comparison outputs of the comparator controlling the plurality of gates so as to output therefrom a sub-frame address signal which is generated so as to change the address frequencies.

6. A drive system for a flat display according to claim 1:

wherein each said sub-frame is composed of an addressing period, during which at least a plurality of cells is selected and written with display data, and a sustaining discharge period, during which said cells that are written with said display data are discharged so as to emit light for a given period of time, and wherein the lengths of the sustaining periods in the sub-frames of a frame are different from each other.

* * * * *

UNITED STATES PATENT AND TRADEMARK OFFICE

CERTIFICATE OF CORRECTION

PATENT NO. : 5,583,527

DATED : Dec. 10, 1996

INVENTOR(S) : FUJISAKI et al.

It is certified that error appears in the above-indentified patent and that said Letters Patent is hereby corrected as shown below:

Col. 1, line 21, change "display" to --displays--.

Col. 2, line 53, delete "that is";
line 55, delete "that is".

Signed and Sealed this

First Day of April, 1997

Bruce Lehman

*Attest:*

BRUCE LEHMAN

*Attesting Officer*

*Commissioner of Patents and Trademarks*